United States Patent [19]

Uecker

[11] Patent Number: 4,850,530

[45] Date of Patent: Jul. 25, 1989

[54] GAS VALVE USING MODULAR CONSTRUCTION

[75] Inventor: Richard P. Uecker, Juneau, Wis.

[73] Assignee: Johnson Service Company, Milwaukee, Wis.

[21] Appl. No.: 133,403

[22] Filed: Dec. 15, 1987

[51] Int. Cl.[4] ..... F23N 1/00

[52] U.S. Cl. ..... 236/1 EB; 137/66; 137/110; 137/489; 137/624.11; 431/62; 431/69

[58] Field of Search ..... 137/66, 495, 489, 624.11, 137/110, 492, 492.5, 599; 431/62, 89; 236/1 EB

[56] References Cited

U.S. PATENT DOCUMENTS

| | | | |
|---|---|---|---|
| 3,300,174 | 1/1967 | Urban et al. | 251/29 |
| 3,351,085 | 11/1967 | Allingham | 137/495 |
| 3,552,430 | 1/1971 | Love | 137/495 |
| 3,749,120 | 7/1973 | Love et al. | 137/495 |
| 3,776,268 | 12/1973 | Visos et al. | 137/489 |
| 4,060,370 | 11/1977 | Fleer | 137/495 X |
| 4,543,974 | 10/1985 | Dietiker | 137/66 |
| 4,549,571 | 11/1985 | Kelly | 137/489 |
| 4,729,396 | 3/1988 | Kelly et al. | 137/66 |

*Primary Examiner*—Stephen Hepperle
*Attorney, Agent, or Firm*—Alexander M. Gerasimow; Edward L. Levine

[57] ABSTRACT

A gas valve for controlling the flow of a combustible, gaseous fuel to a burner employs a modular construction and is configurable to be fast or slow opening, to be step opening or to provide two firing rates in accordance with external signals applied thereto.

5 Claims, 4 Drawing Sheets

GAS VALVE USING MODULAR CONSTRUCTION

This invention relates generally to gas valves for controlling the flow of a combustible, gaseous fuel to a burner and more particularly, to a valve which employs modular construction and which may be configured to be fast or slow opening, to be step opening or to provide two firing rates in accordance with external signals applied thereto.

Gas valves which provide plural firing rates are known, one example being shown in U.S. Pat. No. 4,549,571. The apparatus shown therein uses a bypass regulator and associated passage for initiating a lower burner firing rate and thereafter, uses a main valve with its associated regulating diaphragm for establishing the desired higher firing rate.

A similar apparatus is shown in U.S. Pat. No. 3,776,268. This apparatus provides automatic step opening to result in an initial "soft start" of the burner followed by a higher firing rate. The valve and associated diaphragm used for timing the transition between the "slow start" and higher firing rate has its upper chamber vented to atmosphere.

Another apparatus, which employs a pair of regulators in parallel, is shown in U.S. Pat. No. 3,552,430. The high-fire regulating diaphragm is allowed to separate from its regulating valve member. The time required to close this separation, at opening, provides the "soft light" feature. Still another apparatus is shown in U.S. Pat. No. 3,300,174.

While these devices have generally been satisfactory, they have failed to appreciate the manner in which a gas valve may be constructed in modular fashion to provide slow opening, step opening or controlled dual firing rate configurations.

SUMMARY OF THE INVENTION

In a first embodiment, an apparatus for controlling the flow of gaseous fuel to a main burner includes a first valve for permitting fuel to flow from an inlet to a main pressure chamber and to a pilot burner. A second valve permits fuel to flow from the pressure chamber through a first orifice to a first chamber adjacent the first side of a main valve diaphragm, thereby causing the main valve to commence opening to supply fuel to an outlet. A first pressure regulator is biased closed and includes a regulator diaphragm having a first side and a second side. The first side is in a pressure sensing relationship to the outlet and to a second side of the main valve diaphragm, while the second side of the regulator diaphragm is in a pressure sensing relationship to atmospheric ambient. The pressure regulator is configured to be urged to open an exhaust passage at a predetermined pressure at the outlet, thereby permitting fuel to flow from the main pressure chamber through the first orifice to the outlet. This flow of fuel results in a pressure differential across the main valve diaphragm to maintain the outlet pressure at a substantially constant value. Several embodiments are disclosed.

It is an object of the invention to provide a gas valve which uses modular construction readily arranged to provide one of several control configurations.

Still another object of the invention is to provide an apparatus which uses the main valve and its associated diaphragm to control all firing rates.

Another object of the invention is to provide an apparatus useful with a direct ignition controller.

Another object of a second embodiment of the invention is to provide a gas valve having a timing diaphragm which operates against outlet pressure.

Yet another object of a third embodiment of the apparatus is to provide a gas valve which permits either of two firing rates as controlled by an external signal. How these and other objects of the invention are accomplished will become more apparent from the following detailed description thereof taken in conjunction with the accompanying drawing.

DESCRIPTION OF THE PREFERRED EMBODIMENTS

Figure 1:
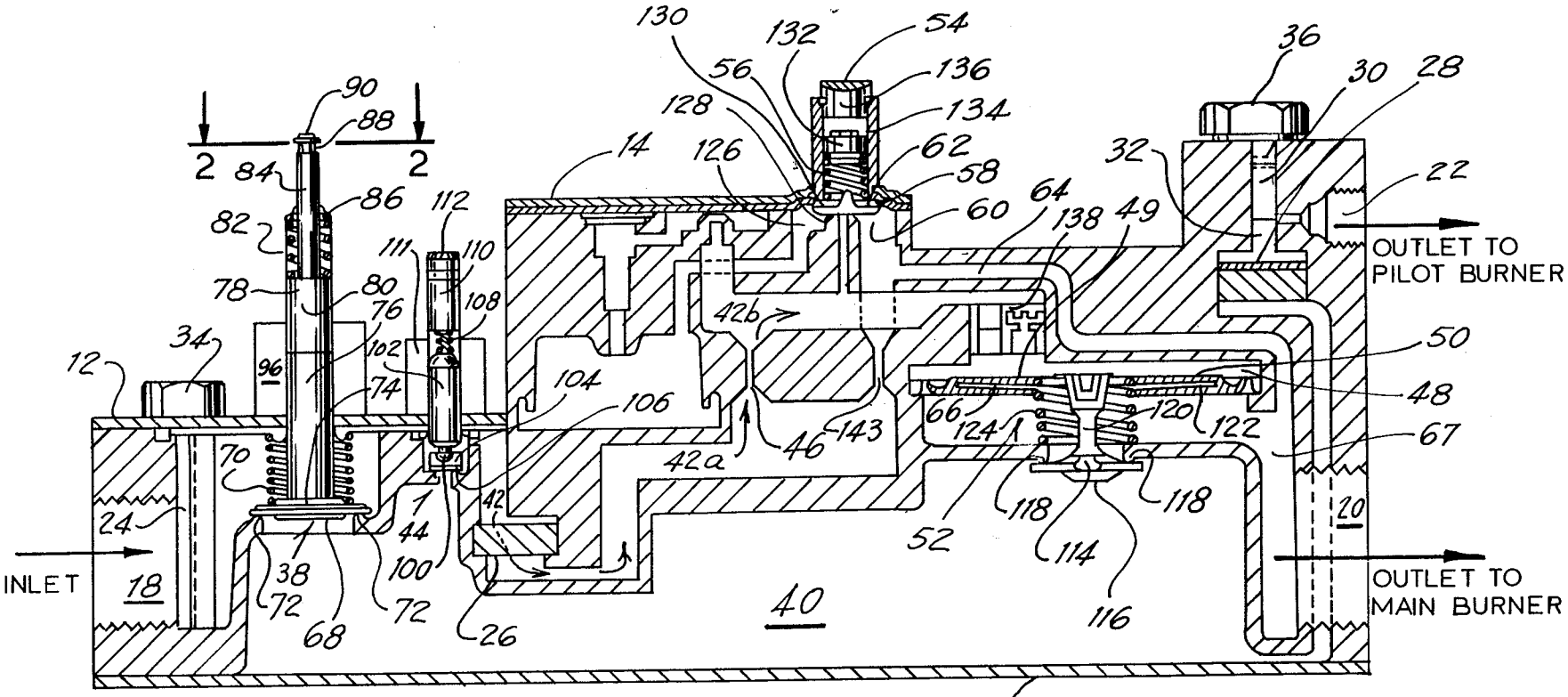
FIG. 1 is a general side elevation view of a first embodiment of the apparatus of the invention, a slow opening valve, shown partly in cross-section with other parts shown in full representation.

Referring to FIG. 1, a first embodiment of the inventive apparatus is shown to include a valve body, generally designated 10, for incorporating various flow and control passages and control devices. A first cover comprised of sections 12 and 14 and a third cover 16 may be removably mounted to the body to facilitate easy inclusion of the various components of control as described hereinafter. In particular, it is to be appreciated that the embodiments may be configured using the covers which are easily installable at the top and bottom of body 10 which may be supported by an assembly bench.

The body 10 includes an inlet 18 connected to a source of gaseous fuel under pressure (not shown), a first outlet 20 connectable to a main burner (not shown) and a second outlet 22 connectable to a pilot burner (not shown). Optionally, the apparatus may also include an inlet screen 24, a servo filter 26 and a pilot filter 28 for removing particulate matter from the gaseous fuel flowing therethrough. The inlet screen 24 may be embodied as a fine plastic or wire mesh, while the filters 26 and 28 may be embodied as felt or other porous filter materials for aiding in the prevention of orifice clogging. A pilot adjustment plug 30 may be disposed adjacent the flow passage 32 to the pilot outlet 22 and may be embodied as a cylindrically-shaped threaded plug received in the passage and having a screw driver slot at the upper terminus. Adjustment is by rotation of the plug to more or less interdict the flow passage to adjust pilot flame height. An inlet pressure tap 34 and an outlet pressure tap 36 may optionally be provided for the attachment of pressure gauges (not shown), an aid in adjusting the apparatus.

The apparatus also includes a first valve 38 for permitting fuel to flow from the inlet 18 to a main pressure chamber 40 and to the pilot outlet 22, the latter through the passage 32. A second valve 44 permits fuel to flow from the main pressure chamber 40 through a first, balance orifice 46 to a first chamber 48 which is adjacent the first side 49 of a main valve diaphragm 50, thereby permitting the main valve 52 to commence opening to supply fuel to the outlet 20. A first pressure regulator 54 is biased to a closed position by a spring 56 and includes a regulator diaphragm 58 having a first side 60 and a second side 62. The first side 60 is connected to the outlet 20 by a sensing passage 64 and therefore, is in a pressure sensing relationship to both the outlet 20 and to the second side 66 of the main valve diaphragm 50, the side being immediately adjacent the chamber 67. The second side 62 of the regulator diaphragm 58 is in a pressure sensing relationship to the atmospheric ambient by virtue of a small vent hole (not shown) in the body 10.

Figure 2:
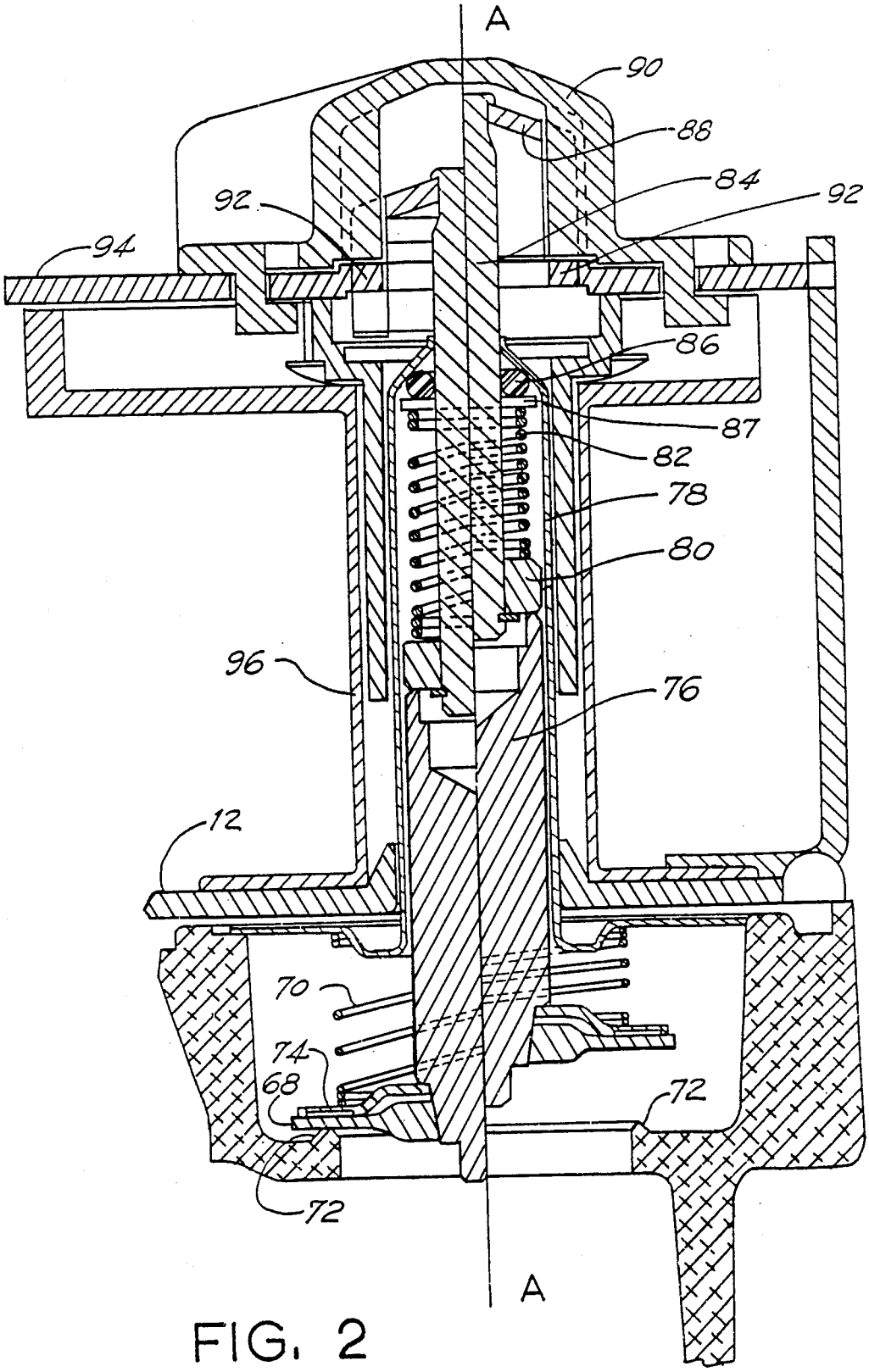
FIG. 2 is a general cross-sectional detailed view of valve 38 taken along line 2—2 of FIG. 1.

More particularly, the first valve 38 is shown in greater detail in FIG. 2 to include a pilot valve seal 68 which is normally biased by a spring 70 to a flow blocking relationship with an annular seat 72. The pilot valve seal is supported by a metal backup plate 74. The seal is coupled to a generally cylindrical magnetic plunger 76 supported and confined within an armature tube 78. An armature stop 80 is received in the tube and, in one position, is downwardly biased by a spring 82 to contact the armature, thereby aiding in maintaining the seal in engagement with the seat, as shown to the left of line "A" in FIG. 2. The stop includes a manual valve shaft 84 which protrudes from an upper aperture in the tube, the interior of the tube and the surrounding ambient being sealed from one another by an 0-ring 86 disposed about the shaft 84 and supported by washer 87. A conventional rotatable cam 88 may be coupled to the shaft 84 and configured to be placed in one of two positions by turning knob 90. In a first position, the underside of the cam is unsupported (shown to the left of line "A" in FIG. 2), thereby permitting the spring 82 to bias the stop to a position in contact with the plunger. When rotated to a second position (shown to the right of line "A" in FIG. 2, but energized with coil 96), the underside surface of the cam contacts two ears 92 of frame top 94 in a manner to lift the stop 80 against the downward urging of the spring 82. When lifted, an air gap is introduced between the stop and the plunger, thereby permitting a first solenoid coil 96 to lift the armature against the urging of the spring 82, thereby opening the pilot valve shown in FIG. 2 right at line "A". This permits fuel to flow from the inlet to the main pressure chamber and to the pilot burner. In operation, this solenoid coil will be energized upon the closure of a thermostatic device (not shown) which signals a demand for heat.

Continuing with reference to FIG. 1, the apparatus also includes a second valve 44 positioned beneath the cover 12 and including a generally ball-shaped extension 100 of the armature 102 having a resilient seal 104 mounted thereon for engaging an annular seat 106, thereby preventing fuel from flowing through the seat. The armature is downwardly biased by a spring 108 interposed between the armature 102 and an armature stop 110. The armature is slidably received in a servo tube 112 while the armature stop 110 is fixed therewithin. Energization of the solenoid coil 111 will move the armature upward, thereby bringing the seal to a spaced relationship with the seat and permitting fuel to flow therethrough. Control of the solenoid coil is typically by a spark or hot surface ignition unit of a known type (not shown) such as the G67 or G74 controller of Johnson Controls, Inc. The activity of the unit is also initiated by closure of the thermostatic device (not shown). The ignition unit (not shown) will generate a spark for ignition of the pilot gas flowing from the outlet 22 and upon detection of an established pilot flame, will generate a signal for actuating the servo solenoid coil 111.

The apparatus includes a main valve 52 embodied to include a ball-shaped extension head 114 having a resilient seal 116 thereon for engaging the annular seat 118, thereby preventing the flow of fuel therethrough. The head is connected by a stem 120 to a diaphragm plate 122 which is positioned against resilient diaphragm 50 which is supported by the body at its peripheral circumference for positioning the head with respect to the seat generally in accordance with the pressure differential thereacross. In the preferred embodiment, the ball-shaped extension, the stem and the diaphragm plate comprise a single integral part. A spring 124 is disposed intermediate the diaphragm plate and the body for biasing the seal to a flow-preventing engagement with the seat and in the absence of an adequate differential pressure across the diaphragm which is sufficient to modulate the seal to a lesser or greater spaced relationship with the seat. It will be appreciated that the first side of the diaphragm senses a pressure which exists in the first chamber 48 while the second diaphragm side 66 senses that which may exist in the chamber 67. It is also to be appreciated that pressure in the chamber 40 will act upon the under area of the seal 116 in a manner to urge the valve closed. However, the under area of the seal is substantially less than that of the first side of the diaphragm.

A first, servo pressure regulator 54 may be assembled below the cover 14 and is shown to include a regulator diaphragm 58 having a first side 60 and a second side 62. The circular periphery of the diaphragm is clamped between the cover and the body for sealing support while the first side includes an annular shaped control area which is in a pressure sensing relationship to the generally annular control chamber 126. The first side also includes a central sealing area which bears against an annular seat 128 to prevent the flow of gas through the passage when the regulator is closed. Closure is by a light biasing spring 56 disposed intermediate a diaphragm plate 130 on the second side and a positionally adjustable stop plug 132 which threadably engages a regulator tube 134. The stop plug may include a screw driver notch (not shown) for regulator pressure adjustment and following adjustment, a seal plug 136 is threadably or expandably (not shown) inserted into the mouth of the tube.

An aperture 138 within the body 10 may be provided to receive a flow restrictor 140 and a one-way check valve 142 in parallel therewith. The restrictor may be configured using an orifice 140 or other means for impeding but not preventing the flow of gas into the first chamber 48 during those times when the pressure in the passage 42 is in excess of that in the first chamber 48 and the check valve 142 is fully closed. During other times when the pressure in the chamber 48 is in excess of that in the passage **42*b* and upon the urging of the spring 124 to close the main valve 52, the check valve 142** freely opens to permit the flow of gas from the chamber to the passage.

OPERATION OF THE FIRST EMBODIMENT

When describing operation, it will first be assumed that no heat is demanded by the system and that the thermostat contacts are therefore open. It will also be assumed that the first valve 38, the second valve 44, the main valve 52 and the pressure regulator 54 are in the closed positions depicted in FIG. 1. It will also be assumed that the camming knob 90 has been rotated to such a position as to lift the stop 80 to introduce an air gap between the stop and the plunger to permit control of the first valve 38 by the solenoid coil 96.

Upon closure of the thermostatic device as resulting from a demand for heat, the pilot valve solenoid coil 96 will be energized and the armature 76, pilot valve seal 68, and backup plate 74 will be lifted against the spring 70 to permit gaseous fuel to flow from the inlet to the main pressure chamber 40 and to the passage which feeds the pilot outlet. Fuel will thereupon flow to the pilot burner (not shown). Simultaneously with the energization of the solenoid coil, the thermostat (not shown) initiates an ignition unit which generates a spark to ignite the pilot gas and establish a pilot flame. Upon detection of the pilot flame, the unit generates a signal to energize the solenoid coil 111 and open the servo valve 44. Fuel is thereupon permitted to flow from the main pressure chamber 40 through the servo filter 26 and through a first balance orifice 46 to the passage and thence through the restrictor 138 to the first side of the main valve diaphragm 50 which defines a wall of the first chamber 48. As the pressure in the first chamber increases, and in recognition of the fact that the pressure at the main burner outlet and therefore at the second side of the diaphragm 66 is essentially atmospheric, the diaphragm will move downwardly against the spring 120 to slowly open the main valve. Fuel will thereupon be permitted to flow at a minimal rate from the main chamber 40 through the main valve 52 to the burner outlet 20 and to the passage which establishes the pressure sensing relationship between the outlet and the control area of the first side 60 of the regulator diaphragm. Upon the occurrence of those events, the control chamber and the main outlet 20 will be at substantially the same pressure above atmospheric. When the pressure in the control chamber rises to a predetermined pressure as set by the position of the stop 132, the seal area of the regulator diaphragm 58 will be urged upward to a spaced relationship with respect to the seat 128, thereby slightly opening the exhaust passage 64. Opening of the exhaust passage will permit fuel to flow through the first balancing orifice 46 to the outlet 20 along the passages 42, **42*a*, 42*b* and 64. This flow of fuel through the first orifice 46 will result in a pressure differential across the main valve diaphragm 50 which is established by the now-metering regulator 54 and which maintains the pressure at the outlet at a substantially constant value. When the demand for heat is satisfied, the thermostatic device opens to de-energize the coils. The pilot valve 38 and the servo valve 44 both close substantially instantaneously and any residual pressurized gas is permitted to flow from the main chamber 40 to the outlet 20 until the main valve 52 closes under the urging of the spring 124. The operation of the spring also causes the main valve diaphragm 50 to move upwardly, diminishing the confined volume of the first chamber 48 and exhausting most of the gas therewithin through the passage 42*b*, the check valve, balance orifice 46, the closing orifice 143, the passage 42*a* and the passage 64** to the outlet. Shortly following the closure of the valves, the pressure at the outlet will diminish to an atmospheric level and the main burner will be extinguished.

Figure 3:
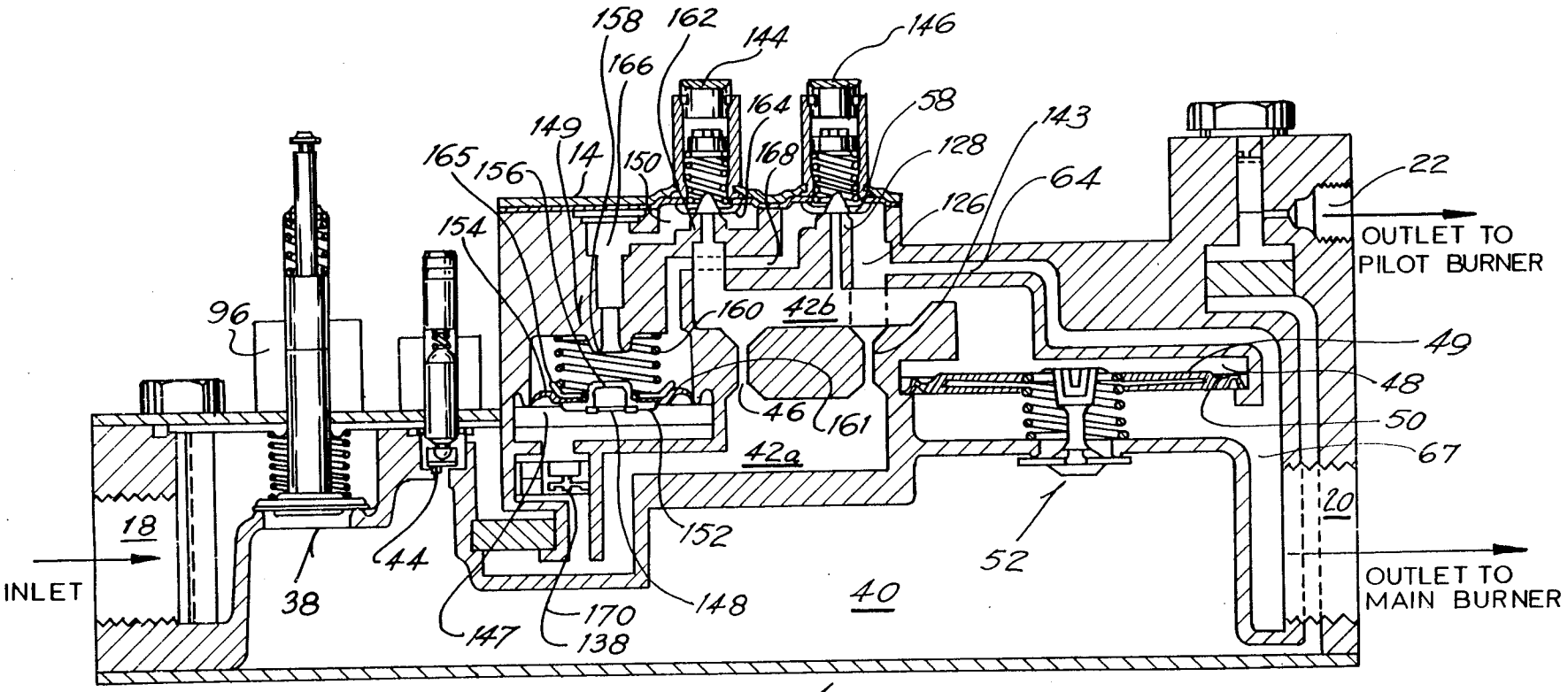
FIG. 3 is a general side elevation view of a second embodiment of the invention, a step opening valve, with portions shown in cross-section and other portions shown in full representation.

Referring next to FIG. 3, a second embodiment of the apparatus, a step opening valve, is shown to include valve means 10 configured for staged operation. This embodiment is identical in some respect to that described with reference to FIG. 1 so that identical parts are assigned like reference numerals. The salient differences will be described hereinafter in greater detail. The valve means is arranged for permitting fuel to flow from an inlet 18 to a main pressure chamber 40 and to a pilot burner (not shown) during a first stage of operation. A main valve diaphragm 50 is provided for controlling the flow of fuel through a main valve 52 through chamber 67, to an outlet passage 20 connectable to a burner (not shown) while a low fire pressure regulator 144 controls the position of the main valve diaphragm 50 during a low burner firing rate. A high fire pressure regulator 146 controls the position of the main valve diaphragm during a high burner firing rate while a one piece, molded rubber, multiple function timing diaphragm 148 coacts with a pressure timing valve 149 for controllably disabling the low fire pressure regulator 144. The valve means 10 is arranged for permitting fuel to flow, during a high fire stage of operation, from the main pressure chamber to the main valve diaphragm, to the timing diaphragm and to the control chambers 150 and 126 of the low and high fire regulators, respectively. The main valve diaphragm thereby moves the main valve to a position for providing a low burner firing rate as set by the low fire regulator. The timing diaphragm 148 thereafter urges the timing valve 149 to a position for disabling the low fire regulator after a time delay. Following this time delay, the main valve diaphragm moves the main valve to a position for providing a high burner firing rate as set by the high fire regulator.

More particularly, the valve means is shown to include a first pilot valve 38 for permitting fuel to flow from an inlet 18 to main pressure chamber 40 and to a pilot burner (not shown). A servo valve 44 permits fuel to flow from the main pressure chamber through a balance orifice 46 to a first chamber 48 adjacent the first side 49 of a main valve diaphragm 50, thereby causing the main valve to commence opening to supply fuel to the outlet 20. Similar to the other diaphragms depicted, the timing diaphragm 148 may be embodied as a generally circular, resilient member which is supported at its circular periphery by the body 10 and has a first, underside 152 and a second side 154. An upwardly projecting timing valve seal 156 is disposed at the center of the diaphragm 148 and is cooperatively configured with an annular seat 158 so that when the valve seal 156 comes to contact with the seat 158, flow through the passage is prevented. A light biasing spring 160 is disposed intermediate the second side 161 of a back-up plate 165 positioned on said 161 of the diaphragm and the body and in a manner to bias the diaphragm downwardly so that the valve is in a spaced relationship to the seat in the absence of a pressure differential across the diaphragm sufficient to overcome the spring. A low fire regulator 144 for establishing the low firing rate and a high fire regulator 146 for establishing the high firing rate are in circuit parallel with one another and are assembled below the cover 14. The construction of these regulators is substantially identical to the construction of the regulator depicted and described with respect to FIG. 1. When urged against the seats 128 and 162 respectively, the low fire regulator diaphragm 164 and the high fire regulator diaphragm 58 function to close the passage **42*b* from communicating with passages 166** and 64, respectively. It is to be appreciated that the passage 64 communicates between the outlet 20 and the control chamber 126 of the high fire regulator diaphragm. It is also to be appreciated that the pressure in that second control chamber 126 is communicated along the passages 168 and 166 to the first control chamber 150 of the low fire regulator unless the blocking valve is in contact with the seat, whereupon such communication is prevented.

Also disposed within the body is a step opening restrictor orifice 170 and a one-way check valve 138 arranged in flow parallel with one another and similar in construction to that described with reference to FIG. 1. When the servo valve 44 is open, the restrictor impedes but does not prevent the flow of gas from the main pressure chamber to that chamber adjacent the first side of the timing diaphragm. At the conclusion of an operating cycle and when the timing diaphragm spring is biasing the diaphragm downwardly to diminish the volume of the chamber, the one way check valve is freely open to permit gas to flow through the second orifice 143 and the passage 64 to the outlet.

OPERATION OF THE SECOND EMBODIMENT

Prior to the start of operation of the valve of the second embodiment, the conditions are assumed to be the same as those set forth above with respect to the embodiment of FIG. 1. During the first stage of operation and upon the closure of a thermostatic device (not shown), the coil 96 is energized and the pilot valve 38, a portion of the valve means, is opened to permit fuel to flow from the inlet 18 to the main pressure chamber 40 and to the pilot burner. Upon detection of an established pilot flame and during a second stage of operation, the servo valve 44 portion of the valve means permits fuel to flow to the first side of the main valve diaphragm 49 along a path which includes the passages 42*a* and 42*b*, and the balance orifice 46. Thereupon, a differential pressure will be established across the main diaphragm 50 and it will begin to open the main valve 52, thereby permitting fuel to flow from the main chamber 40 to the outlet 20. The resulting outlet pressure is communicated to the control chamber 126 of the high fire regulator and, by the passage 168 and the passage 166, to the control chamber 150 of the low fire regulator 144. At some outlet pressure determined by the setting of the low fire regulator 144, its control area will move slightly upward to a position in a spaced relationship from the seat, thereby metering the flow of gas through the passage. The apparatus will thereupon come to a state of equilibrium at the low firing rate until the occurrence of the events described following.

Opening of the servo valve portion of the valve means also permits fuel to flow from the main chamber 40 to the first side 152 of the timing diaphragm 148 along a path which includes the passages 42*a* and 147, and the restrictor 170. It is to be appreciated that since the burner is being fired at a lower rate, the pressure at the outlet, that communicated to the second side 154 of the timing diaphragm 161, is sufficiently below the pressure of the inlet, that communicated to the first side of the timing diaphragm, to result in a pressure differential across the diaphragm which acts to urge the timing valve toward the seat. As fuel continues to flow through the restrictor, the magnitude of this differential pressure will increase and at some value, the timing valve will come to engagement with the seat and the control area of the low fire regulator will be prevented from further sensing the pressure at the outlet and the low fire regulator will thereupon be disabled. Thereafter, the pressure at the first side of the main valve diaphragm continues to increase, the main valve is urged to a more fully open position and the pressure at the outlet increases and, therefore, the firing rate continue to increase. At some outlet pressure determined by the setting of the second regulator, its control area of the diaphragm will move slightly upward to a position in a spaced relationship from the seat, thereby metering the flow of gas through the passage. The apparatus will thereupon come to a state of equilibrium at the high firing rate until the thermostat contacts are reopened.

Upon opening of the thermostat contacts, both valves of the valve means are de-energized to a closed position. Gas confined in the chamber adjacent the first side of the timing diaphragm and in the chamber adjacent the first side of the main diaphragm are permitted to exhaust via passage 42*a*, closing orifice 143, and passage 64 to the outlet by the urging of the springs 160 and main spring respectively, and main burner firing ceases. The main valve diaphragm exhausts through passage 42*b*, balance orifice 46, passage 42*a*, closing orifice 143, and passage 64.

Figure 4:
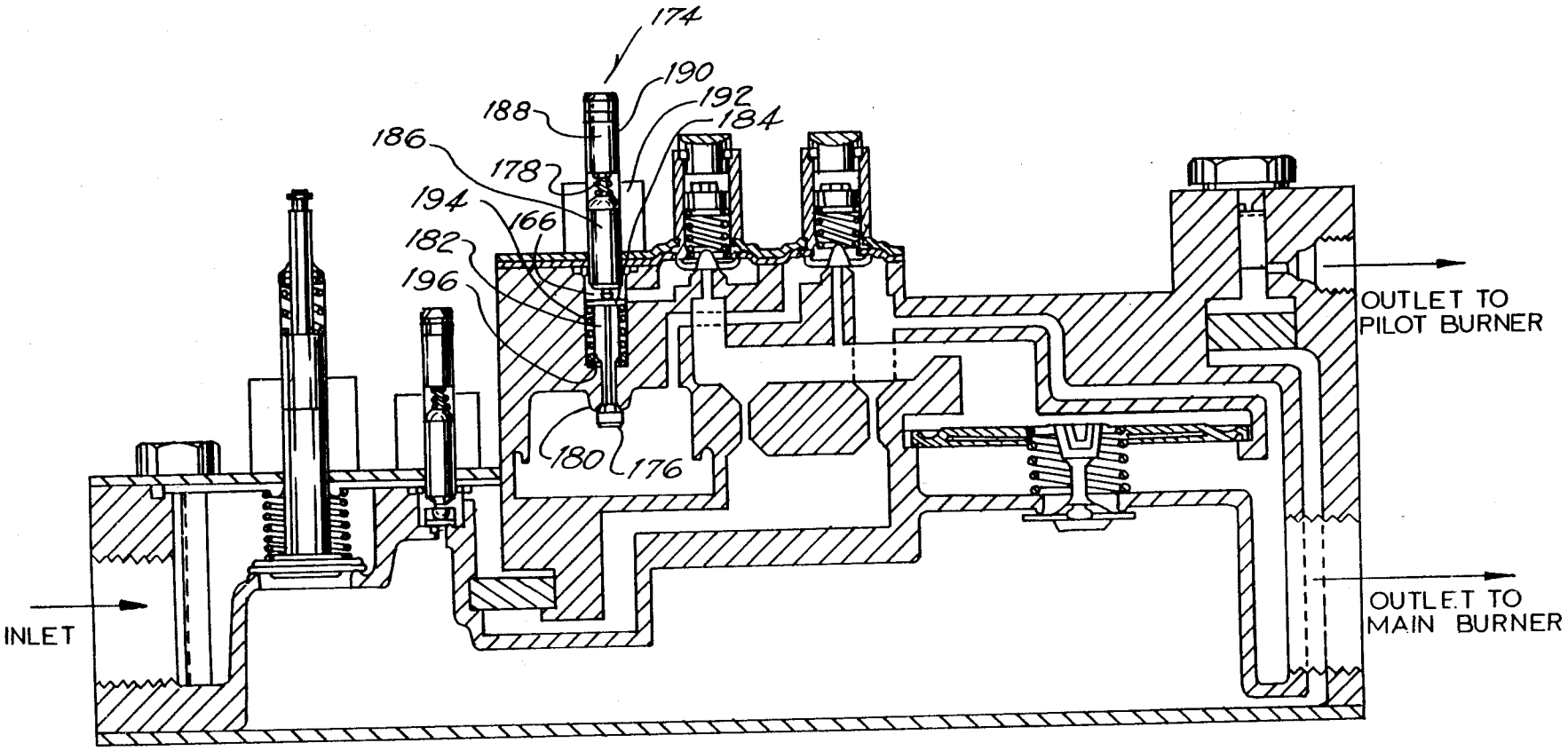
FIG. 4 is a general side elevation view of a third embodiment of the invention, a dual rate valve, for providing either of two firing rates in accordance with external signals, the depiction being partly in cross-section and partly in full representation.

Referring now to FIG. 4, a third embodiment is depicted as a dual rate gas valve apparatus, the rates being selectable by an external control device. This third embodiment differs only slightly from that of the second embodiment shown in FIG. 3 in that the restrictor and valve 170 may be omitted and the timing diaphragm 148 and its associated structure may also be omitted. In place thereof, a high fire servo valve 174 has a valve seal 176 biased by a spring 178 to a spaced relationship with its seat 180, i.e., the high fire servo valve is of a normally open construction. The seal is attached to a stem 182 which is received in a passage 166 and having a stop disk 184 at the top. The stem and the disk are fluted or otherwise configured to permit the free flow of gas thereacross. In turn, the stem is biased downward by a magnetic armature 186 which may be in contact therewith, the armature being urged downwardly by spring 178 disposed intermediate the armature and a stop plug 188. The armature is slidably received within a guide tube 190 while the stop plug is fixed therewithin. When energized, a solenoid coil 192 will draw the armature upward, thereby introducing a space between the armature nose and the disk. Thereupon, the normally open high fire valve will be closed by a spring 194 disposed between stop disk 184 and a shoulder 196 formed in the valve body.

OPERATION OF THE THIRD EMBODIMENT

Prior to the start of operation, the conditions are assumed to be as set forth above. If only the coil 96 and the servo coil are energized, the burner will be fired at a lower rate established by the setting of the first regulator. If an external control device, a boiler monitor for example, determines that a higher firing rate is required, it will energize the coil 192 to draw the armature upward, thereby permitting the high fire servo valve to close and disable the first regulator. Thereafter, a higher firing rate will continue and as established by the setting of the second regulator.

While only a few embodiments of the inventive apparatus have been shown and described, it is not intended to be limited thereby but only by the scope of the claims which follow.

I claim:

1. A step opening valve for controlling the flow of gaseous fuel to a burner and including:

valve means configured for staged operation, said means being arranged for permitting fuel to flow from an inlet to a main pressure chamber and to a pilot burner during a first stage of operation;

a main valve diaphragm for controlling the flow of fuel through a main valve to an outlet passage connectible to said burner;

a first regulator for controlling the position of said main valve diaphragm during a low burner firing rate;

a second regulator for controlling the position of said main valve diaphragm during a high burner firing rate;

a timing diaphragm coacting with a pressure blocking valve for controllably disabling said first regulator;

said valve means being arranged for permitting fuel to flow, during a second stage of operation, from said pressure chamber to said main valve diaphragm, to said timing diaphragm and to the control areas of said first and second regulators;

said main valve diaphragm thereby moving said main valve to a position for providing said low burner firing rate as set by said first regulator;

said timing diaphragm thereafter urging said blocking valve to a position for disabling said first regulator after a time delay;

following said time delay, said main valve diaphragm moving said main valve to a position for providing said high burner firing rate as set by said second regulator.

2. The invention set forth in claim 1 wherein said timing diaphragm includes a first side and a second side and said fuel is permitted to flow to said first side during said second stage of operation of said valve means, said second side being at substantially the same pressure as said outlet passage.

3. The invention set forth in claim 2 wherein the said control areas of said first regulator and said second regulator are at substantially the same pressure one to the other prior to the disabling of said first regulator by said blocking valve.

4. The invention set forth in claim 3 wherein during said second stage of operation, fuel flows from said pressure chamber to said main valve diaphragm through a first orifice, the pressure differential across said main valve diaphragm being a function of the rate of flow of said fuel through said orifice.

5. The invention set forth in claim 4 wherein said first stage of operation is controllable by a thermostatic device and said second stage of operation may be initiated by the establishment of a pilot flame as detected by an ignition controller.

* * * * *